United States Patent [19]

Munzel et al.

[11] 4,147,834

[45] * Apr. 3, 1979

[54] FLUORINATED POLYMER COATED CARRIER PARTICLES

[75] Inventors: Howard E. Munzel; Carl A. Queener, both of Lexington, Ky.

[73] Assignee: International Business Machines Corporation, Armonk, N.Y.

[ * ] Notice: The portion of the term of this patent subsequent to Mar. 30, 1993, has been disclaimed.

[21] Appl. No.: 750,997

[22] Filed: Dec. 14, 1976

Related U.S. Application Data

[60] Division of Ser. No. 596,022, Jul. 11, 1975, abandoned, which is a division of Ser. No. 472,335, May 22, 1974, Pat. No. 3,947,271, which is a continuation of Ser. No. 226,015, Feb. 14, 1972, abandoned.

[51] Int. Cl.[2] ..... G03G 9/02; G03G 13/08

[52] U.S. Cl. ..... 428/407; 252/62.1 P; 427/213; 427/215; 427/216; 427/221

[58] Field of Search ..... 96/1 SD; 252/62.1; 427/27, 213, 216; 27/19; 428/407

[56] References Cited

U.S. PATENT DOCUMENTS

| | | | |
|---|---|---|---|
| 3,798,167 | 3/1974 | Kukla et al. | 252/62.1 |
| 3,873,356 | 3/1975 | Queener | 96/1 R |
| 3,900,587 | 8/1975 | Lenhard | 96/1 R |
| 3,947,271 | 3/1976 | Munzel et al. | 96/1 SD |

OTHER PUBLICATIONS

Dupont - Teflon Finishes Bulletin #1, Eleventh Ed.

*Primary Examiner*—Roland E. Martin, Jr.
*Assistant Examiner*—John L. Goodrow
*Attorney, Agent, or Firm*—Abraham A. Saffitz

[57] ABSTRACT

A carrier bead is disclosed having a core and at least an outer coating of polytetrafluoroethylene or fluorinated ethylene propylene. Use of these fluoropolymers as carrier coatings results in extremely long carrier life and overcomes problems that have heretofore plagued the commercialization of a magnetic brush development system for a plain paper electrostatic copying apparatus.

3 Claims, 1 Drawing Figure

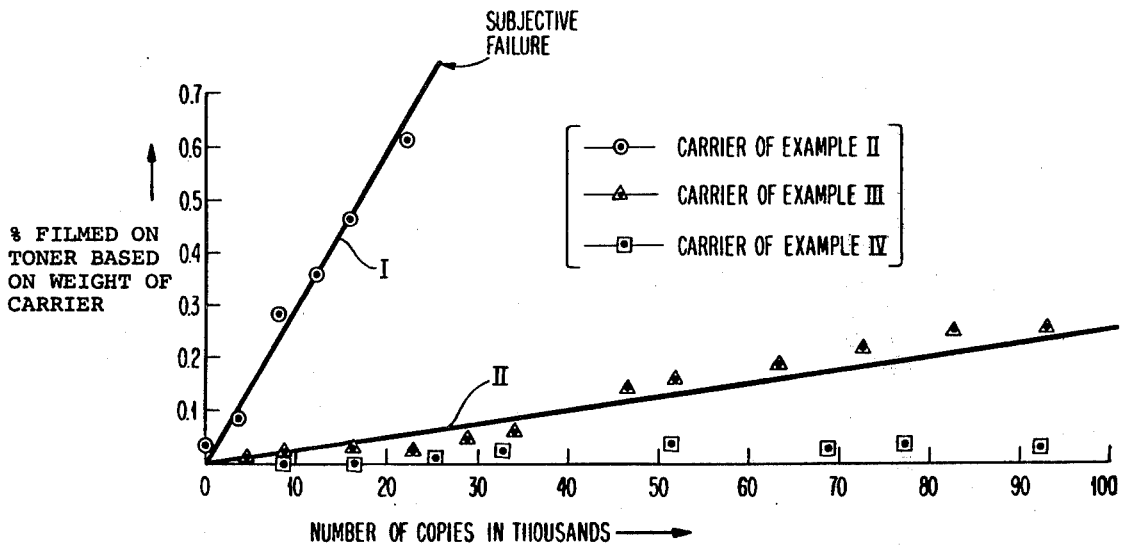
SUBJECTIVE FAILURE
% FILMED ON TONER BASED ON WEIGHT OF CARRIER
0.7
0.6
0.5
0.4
0.3
0.2
0.1
I
II
CARRIER OF EXAMPLE II
CARRIER OF EXAMPLE III
CARRIER OF EXAMPLE IV
0
10
20
30
40
50
60
70
80
90
100
NUMBER OF COPIES IN THIOUSANDS

FLUORINATED POLYMER COATED CARRIER PARTICLES

This is a division of application Ser. No. 596,022, filed July 11, 1975 now abandoned, which is a Rule 60 Divisional Application of prior Ser. No. 472,335, filed May 22, 1974, now U.S. Pat. No. 3,947,271, which in turn is a Rule 60 continuation of Application Ser. No. 226,015, filed Feb. 14, 1972 abandoned.

CROSS REFERENCED RELATED COPENDING APPLICATIONS

U.S. patent application Ser. No. 110,756, entitled Coated Carrier Particles, Method of Making Same, and Improved Electrophotographic Process, by C. A. Queener et al and filed Jan. 28, 1971 now U.S. Pat. No. 3,778,262.

U.S. patent application Ser. No. 110,725, entitled Coated Carrier Particles with Polarity and/or Magnitude of Triboelectric Charge Controlled, Method of Making Same, and Improved Electrophotographic Process, by W. J. Kukla et al filed Jan. 28, 1971 now U.S. Pat. No. 3,798,167 granted Mar. 19, 1974.

U.S. patent application Ser. No. 226,015, entitled Method for Manufacturing Carrier Particles for Use in Electrophotographic Processes, by H. E. Munzel et al, filed Feb. 14, 1972 now abandoned.

All the above applications are assigned to the same assignee as this application.

BACKGROUND OF THE INVENTION

In electrophotography, a photoconductor is charged and then exposed imagewise to light. In the area of the photoconductor exposed to light, the charge dissipates or decays while the dark areas retain the electrostatic charge.

The difference in the charge levels between the areas exposed to light and the dark areas produces electrical fields therebetween. Accordingly, the resultant latent electrostatic image on the photoconductor is developed by depositing small colored particles, which are known as toner particles, over the surface of the photoconductor with the toner particles having a charge so as to be directed by the electrical fields to the image areas of the photoconductor to develop the electrostatic image.

A number of means are known for developing the latent electrostatic image by the application of the toner particles. One of these is known as cascade development and is described in U.S. Pat. No. 2,618,552 to Wise.

Another means is known as the magnetic brush process. This method is described in U.S. Pat. No. 2,874,063 to Greig.

In each of the cascade and magnetic brush development processes, a two component developer material is utilized. The developer material comprises a mixture of small toner particles and relatively large carrier particles. The toner particles are held on the surfaces of the relatively large carrier particles by electrostatic forces which develop from the contact between the toner and carrier particles producing triboelectric charging of the toner and the carrier to opposite polarities. When the developer material is moved into contact with the latent electrostatic image of the photoconductor, the toner particles are attracted to the latent image.

The toner and carrier particles of the developer material are specially made and processed so that the toner obtains the correct charge polarity and magnitude of charge to insure that the toner particles are preferentially attracted to the desired image areas of the photoconductor. For a given developer-hardware system, the magnitude of the triboelectric charge is important in that if such charge is too low, the copy will be characterized by high print density but heavy background and poor resolution; if the charge is too high, the background and resolution is good but the print density will tend to be low. Thus, there is an optimum range of toner charge for best overall results.

Prior art dry developer materials, which are employed in automatic copy machines, have carrier filming problems due to the recycling of the carrier particles through many cycles which produces many collisions between the carrier particles and between the carrier particles and parts of the machine. The attendant mechanical friction causes some toner material to form a physically adherent film on the surfaces of the coatings of the carrier particles.

When this occurs, there is a gradual accumulation of a permanently attached film of toner material on the surfaces of the carrier particles. In such a film, the toner appears to lose its original particulate shape and form plaques that are tenaciously adherent to the carrier bead surface. This film of toner impairs the normal triboelectric charging of the toner particles in the developer mix because the normal toner-carrier triboelectric charging is partly replaced by a toner-toner relationship. As a result, the toner which is available for developing the latent electrostatic image is less highly charged on the average. If this occurs to a sufficient degree, the improperly charged toner particles can be deposited on the non-image areas whereby the quality of the copies is impaired since the non-image areas possess an unacceptable level of background toner.

When toner filming occurs to a sufficient degree, the entire developer material must be replaced thereby increasing the cost of operation of the copy machine. Furthermore, it is time consuming. This problem is especially significant in high speed copy machines in which thousands of copy cycles occur in a relatively short period of time or in copy machines in which the developer is continuously agitated.

The toner filming mode of failure has been observed as the dominant mode of failure of carrier beads in the past, as it manifested itself relatively early in the life of the developer mix and for otherwise good carrier coatings the other modes did not occur at this early point in the carrier life. Spalling and abrasive wear out did not generally cause the carrier to fail as these mechanisms were slower. Only after the toner filming failure was at least partially overcome did the other failure modes become significant problems to be addressed. Only at this point did material properties possibly affecting these failures become of prime interest and efforts were made to identify properties which contribute to the solution of these failure problems.

Furthermore, because of the contact between the carrier particles and between the carrier particles and parts of the machine, there is abrasion of the coating of the carrier particles. This abrasion of the coating also may reduce the effectiveness of the triboelectric charging between the carrier and the toner by effectively exposing the toner to the core material of the carrier, if the abrasive wear proceeds far enough.

Thus, if the coating is not sufficiently resistant to abrasion, early replacement of the entire developer material is required. Again, this replacement of the entire developer material is costly and time consuming, especially in high speed copy machines.

Furthermore, even if the coating of the carrier particle resists abrasion, the coating also must have good adhesion to the core of the carrier particle in order to prevent loss of the coating by fracture at the core-coating interface. Otherwise, the coating can chip, flake or spall due to the rubbing or contact between the various carrier particles and between the carrier particles and parts of the machine. This also requires early replacement of the developer material.

In addition to having the foregoing desired properties, the carrier particles must have the characteristic of having a triboelectric charge of a desired magnitude and polarity when used with a particular electroscopic toner. This is because the magnitude of the triboelectric charge of the toner is controlled by the magnitude and polarity of the carrier charge when the toner and the carrier are mixed.

The magnitude of the charge of the toner is important for the electrophotographic system to produce copies of an excellent quality. If the magnitude of the charge of the toner is too low, the images have poor edge definition and lack contrast since the non-image or background areas possess an unacceptable level of toner as previously mentioned. If the magnitude of the charge of the toner is too high, then there is poor image fill since the toner would tend to stay with the carrier. Accordingly, the magnitude of the charge of the toner must be within a range above that in which poor edge definition is produced and below that in which poor image fill occurs.

Thus, if the coating of the carrier particle has the characteristic of imparting a triboelectric charge to the toner when mixed therewith so that the toner charge does not fall within the range in which copies of high quality can be obtained, the coating cannot be employed for a carrier for the toner even though it meets the abrasion, anti-stick, and adhesion requirements. Accordingly, for a carrier coating to be satisfactory, it not only must meet the abrasion, anti-stick, and adhesion requirements but also must be capable of triboelectrically charging the toner to a level within a desired range that enables copies of high quality to be produced.

Carrier failure modes have heretofore been rather incompletely understood. As an example of the lack of understanding of carrier failure modes, the term "tired iron" has been used to describe failure of a steel or iron filing carrier to triboelectrically charge toner after it has been used as a carrier for some time. The primary modes of failure which occur in a developer mix are filmed-on toner, spalling, and abrasive wear. Heretofore, filmed-on toner has been the dominant mode of early carrier failure. The carrier beads acquire a thin film of fused toner material and thus triboelectrically fail long before the coatings on the beads have spalled from the cores. When a carrier coating is discovered which inhibits the filmed-on toner failure, the failure mode shifts to spalling. If the coating also resists the spalling failure then the next progressive mode of failure is abrasive or adhesive wear of the triboelectric carrier coating.

The presently known requirements of a carrier coating material other than a triboelectric relationship are thus dictated by these failure modes. Low surface energy is a very substantial consideration when attempting to overcome the dominant failure mode of carrier materials-- filmed-on toner.

The adhesion qualities of a particular resin are pertinent when filmed-on toner is not a problem and the failure mode becomes that of spalling of the carrier coating from the carrier bead. When a material is found which provides adequate resistance to the failure modes of filmed-on toner and spalling, the abrasive or adhesive wear characteristics of that material then become a primary consideration in attempting to lengthen the life of the carrier material. As can be seen from the foregoing, the understanding of carrier failures has developed only as carrier materials have been selected and as they have been forced to a failure point. Therefore, the criteria for materials which can be used for carrier coatings to impart triboelectric charge to toner particles, have been developed through failure in a trial and error type process.

Otherwise useful and high quality carriers suffer greatly degraded useful lives when used in hostile developer environments. Examples of such hostile environments are development electrode cascade developer apparatus and magnetic brush developer apparatus.

One example of the degree of degradation of carrier life in a development electrode developer assembly is an automatic electrostatic copier which is commercially available with or without a development electrode. When that copier is constructed with a cascade developer without a development electrode the published life of the charge of carrier is 300,000 copies between carrier replacement. When a development electrode is installed in the same model machine the same carrier charge must be replaced after only 100,000 copies. This decrease of about 66% in the useful life of the carrier is ample evidence of the hostility of development electrodes in cascade developers. These machines use 25 pound charges of carrier, thus producing only 4,000 copies per pound of carrier when using a development electrode.

Development of latent electrostatic images by magnetic brush development has proved to be a substantial problem ever since the original technique was disclosed in U.S. Pat. No. 2,847,063 to Greig, as referenced above. It has long been recognized that the magnetic brush technique of developing will produce very superior copy quality and also to some extent that it removes restrictions on speed of the copy process placed there by the cascade or powder cloud development techniques. There have also been substantial technological and economic barriers which heretofore have prevented substantial penetration in the market of a commercially acceptable magnetic brush developer unit for a plain paper copier. The primary reason for the technological and economic barriers has heretofore been that the violent agitation of the developer mixture of carrier beads and toner particles has created localized heating and the filming of toner onto the carrier particles much more rapidly and much more detrimentally to the process, than was experienced in cascade development. An additional reason for the apparent failure of the carrier may possibly be explained by the great weight and density of the magnetic core material such as iron grit and steel shot. The substantially greater weight and density of these materials results in increased impact of the carrier beads into one another, the photoconductor, the developer assembly and mechanisms, and the equipment necessary to carry the steel carrier beads to the development zone. This impacting appears to cause some localized heating which then promotes the filming of the toner particles carried by the carrier beads and further results in faster failure of the carrier beads.

In a magnetic brush developer the magnetic carrier beads are formed into a magnetic brush of tendrals of carrier beads and toner particles extending outwardly through the magnetic field of force. This brush vigorously scrubs, at relatively high speed, these tendrals against the photoconductive member bearing the latent electrostatic image. There is, of necessity, some violent scrubbing, agitation and impacting of the carrier beads and the toner particles. Additionally, the developer mix must be agitated, mixed or blended in order to assure a uniform developer mix throughout the operation of the machine. Solutions to this blending problem have been usually solved with continuous mechanical blenders such as augers or paddle blades which continually stir the developer mix to assure uniformity. All of this action contributes to the potential failure of the carrier by filmed on toner. Due to the violent agitation, the coating material on the steel shot (or magnetic core) must additionally adhere to the core with great tenacity to prevent the coating material from chipping, flaking, or spalling off of the core material.

Until very recently, there has been no commercially available plain paper copier using electrostatic copying in the domestic United States market which embodied a magnetic brush developing unit. Recently one new copier product has been marketed which embodies a magnetic brush apparatus. One charge of carrier beads for this developer mix must be replaced after approximately every 10,000 copies, yielding a life on the order of 1,000 to 3,000 copies per pound of carrier. Relatively short carrier life has heretofore made such a developer mix and mechanism lack economic feasibility in the commercial marketplace.

As a basis for comparison, the life of the carrier beads utilized in one commercially available electrostatic plain paper copier utilizing a cascade development system, has been rated as high as 750,000 copies per a seven pound charge of carrier. When gauged against the life of the carrier in a cascade developer apparatus, carrier beads for magnetic brush developers have a short life and thus increase the operating cost of such a machine by a large factor. This increases the ultimate cost per copy to the customer, and thus the process has heretofore had economic disadvantages.

PRIOR ART

The development of materials for use as triboelectric coatings on carrier cores, has been highly emperical. As a background of knowledge develops as to the functional characteristics of carriers and the properties required of carrier coatings, it has been somewhat possible to screen materials to determine their potential as carrier coatings. It has been possible to say that materials must have certain physical and mechanical properties and that they must maintain acceptable properties at the machine operating temperatures and relative humidities. However, this yields a relatively large class of possible candidate materials. After this large class of candidate materials has been screened for triboelectric characteristics, then the emperical nature of the carrier art dictates that the candidate material must be functionally evaluated.

The only way then to determine whether the materials will actually function and to what extent that are viable carrier coatings is to actually make carrier beads with these materials as coatings and to test them. Even if a material is a highly probable candidate triboelectrically and has the appropriate physical/mechanical characteristics required for a good carrier, it may well be that a material is not capable of being coated onto a carrier bead or that some other manufacturing requirements cannot be met and thereby render the material unsatisfactory as a carrier coating. One of skill in the art would take a class of selected materials believing them all of process generally the same order of magnitude of performance capability and would have no reliable way to predict which of those materials might perform unexpectedly as regards either quality or carrier life.

The prior art has to some extent classified candidate materials into the broad class of generally desirable materials discussed above, but has not been able to reliably predict the viability or advantages of any particular material over and above the larger body of materials in the class. The analysis of potential carrier materials may at first appear to be logical and straight forward. However, there are great difficulties associated with deducing failure mechanisms of particular carrier coatings from an analysis of symptoms manifested in the output copy. Additionally there is a great lack of a more complete knowledge of how given failure mechanisms are affected by particular properties of selected materials, all of which leads one skilled in the art generally to a case by case, trial and error, emperical selection of coating materials.

Additionally, some of the materials which may result as likely candidates during the initial screening process may well turn out to be totally unacceptable carrier material candidates because of some failure mechanism with which we are not at present fully conversant and do not understand, or they may not be adaptable to known manufacturing techniques.

German Offenlegungschrift No. 2,124,409 filed in Germany May 17, 1971 and puslished Dec. 2, 1971 and open to public inspection, further indicates the relatively short life of magnetic brush carrier beads wherein examples of severe degradation in copy quality, due to carrier bead failure, was observed after only 900 copies in one example and extremely poor copy quality was encountered after 2,400 copies in another example. No statements of the quantity of carrier beads are made, thus definitive comparisons are not possible. However, it is evident that carrier life is very short in these examples.

From the foregoing it is apparent that a major if not the primary limiting factor in the ultimate use of a magnetic brush developer apparatus in an automatic electrostatic plain paper copier, is the life of the carrier in the development mix, and that the development of a good carrier coating is to a large extent a trial and error process.

It is also apparent from the foregoing and from the large quantity of other work done as evidenced by the prior art, that there has been a long felt need for a carrier which can withstand the abuse and violent agitation, impacting, grinding, rubbing, and brushing encountered in hostile development environments, and particularly in a magnetic brush developing unit and that such an acceptable carrier material having a long and economically useful life has not heretofore been known. The many patents suggesting and alluding to the use of varied coating materials and carrier beads in a magnetic brush developer apparatus is evidence of a long and extensive research effort to find a solution to a problem which until recently was not understood. There has been a long felt need in the industry and there have been no highly feasible solutions to these failures as evidenced by the almost total lack of commercially available magnetic brush development in plain paper copiers.

OBJECT OF THE INVENTION

It is an object of this Invention to increase the useful life of electrophotographic carriers in electrophotographic processes having hostile development environments.

It is another object of this Invention to reduce the propensity for carrier failure in a development mixture of an electrophotographic apparatus.

It is a further object of this invention to improve heretofore known electrophotographic processes by the use of an improved carrier material in the development mixture to enhance the longer life of the development mixture.

It is still another object of this invention to reduce the carrier failure attributable to toner filming of carrier materials.

It is still an additional object of this invention to reduce failure of electrophotograph carrier beads through the spalling mode of failure.

It is the primary object of this invention to provide an improved carrier bead for use in an electrophotographic apparatus.

SUMMARY OF THE INVENTION

The foregoing objects are accomplished and the above described disadvantages of the prior art are overcome by the use in an electrophotographic process, as earlier described, of a plurality of carrier beads having as exterior layers or coatings, a fluorocarbon which is substantially fully fluorine saturated. Carrier beads are coated with a thin coating of a fluorocarbon such as polytetrafluorethylene or a fluorinated ethylene propylene, in a manner which will yield a relatively thin, substantially uniform coating of the fluorocarbon polymer adhered with tenacity to the core material, when the sintering and coalescing of the particles of the coating is completed by a curing step. Further improvement of the carrier material may be had by coating a primer material between the core material and the outer coating of a fluorocarbon. This thin substantially uniform layer of primer material enhances the adhesion between the outer coating of the fluorocarbon and the core material.

This carrier coating material, when coated upon a magnetic core, yields a highly electronegative magnetic carrier bead. The improved carrier bead has very low surface energy, a low coefficient of friction, and good adhesion between coating and core. The low surface energy characteristic helps overcome the problem which has heretofore resulted in failure of the carrier material in a mode generally known as filmed on toner.

DESCRIPTION OF THE DRAWING

The drawing is a graph representing the comparitive rates of failure of carrier beads having varying outer coatings due to toner filming onto the carrier bead.

DESCRIPTION OF THE INVENTION

The foregoing objects and advantages can be accomplished by the use of a plurality of carrier beads intermixed with toner particles in the developer housing of an electrophotographic apparatus, where the carrier bead has an exterior coating of a low surface energy fluoropolymer and more specially a low surface energy fluorocarbon which is substantially fully saturated with fluorine. In the foregoing description, specifications, and claims, a fully saturated fluorocarbon is intended to mean that the saturation is a saturation of fluorine atoms in the polymeric chain, and by fully saturated or substantially full saturation, it is intended that substantially all of the available hydrogen atoms on the polymeric chain have been replaced by fluorine atoms so that the available sites for fluorine have been fully saturated by the fluorine atoms and hydrogen atoms generally do not exit within the polymer. The known fluoropolymers that meet this definition are polytetrafluoroethylene and fluorinated ethylene propylene.

In the practice of this invention, particulate core material is coated with either polytetrafluoroethylene or fluorinated ethylene propylene to provide a highly electro negative electrophotographic carrier material. Specific examples of coatings of polytetrafluoroethylene and comparative examples of other carrier coatings are more fully enumerated below where the life of the carrier is dramatically demonstrated to be substantially longer when using low surface energy fluorocarbon materials.

A discussion of problems involved with one of the hostile environments is made above with specific reference to the violent agitation inherent in a magnetic brush developing apparatus. Another hostile environment is that of a cascade development unit which embodies a development electrode where voltage biases are applied to the electrode to promote the transfer of the toner particles from the carrier beads to the electrostatic latent image being developed.

The five examples that follow will clearly demonstrate that although the prior art in many cases indicates that a good carrier coating material for one type of development is generally good for other types of development, hostile development environments drastically reduce the expected life and/or utility of a particular carrier coating.

In brief summary, against which a clearer understanding of the value of this invention can be had, Example 1 is an example of a carrier coating which provides excellent copy quality and excellent carrier life in a conventional cascade development apparatus where 7 pounds of carrier provides a life of approximately 750,000 copies, thus yielding something in the order of 107,000 copies per pound. Example 2 provides a comparison of substantially the same carrier coating when coated upon a magnetic core material for use in a magnetic brush developer where significant degradation of copy quality was experienced at approximately 15,000 copies and failure occurred at approximately 27,000 copies utilizing 14 pounds of developer mixture, 99% of which was the coated carrier beads. This results in significant degradation in slightly more than 1,000 copies per pound and carrier failure at slightly less than 2,000 copies per pound of carrier.

Example 3 is an example of polytetrafluoroethylene coated upon steel beads and used in the same environment as that of Example 2 and where 35,000 copies were made before determinable degradation of copy quality occurred and where 100,000 copies were run with still acceptable copy quality although the carrier beads suffered damage to their physical integrity. On a like basis, this test results in a 7,000 plus copies per pound of developer mix using polytetrafluoroethylene coated steel beads. Example 4 describes a carrier made by priming steel beads with a Teflon primer for steel and then overcoating the beads with polytetrafluoroethylene and repeating the tests of examples 2 and 3. Again a 14 pound charge of this carrier was run through 100,000 copy cycles with no substantial copy quality degradation and only a relatively small amount of physical damage to the beads. The tests were terminated at this point thus resulting in over 7,000 copies per pound of carrier beads, and no carrier failure.

Example 5 uses substantially the same carrier material as Example 4 in a substantially similar magnetic brush developer unit utilized in Examples 2, 3, and 4 wherein a developer batch weighing approximately 22 pounds is employed. The test was run to 250,000 copies with copies at the 250,000 point having good half tones, good extended area coverage, low background, good resolution, and little spalling, chipping, or flaking of the coating of the carrier bead. The carrier had not failed and the test was continued. At this point without having reached failure, the carrier charge had produced in excess of 11,000 copies per pound with the ultimate expected life of the charge far exceeding 250,000 copies.

With the above summary analysis of the examples to follow, a better understanding of the relative useful lifes of carrier coatings may be had while understanding the method of making and utilizing electrophotographic carriers.

To provide the above results the following coating procedures and tests were conducted.

EXAMPLE 1

A coating formulation containing about 11% by weight Exon 497 resin, a polyvinyl chloride/polyvinyl acetate copolymer, which is sold by Firestone Plastics Company, Pottstown, Pennsylvania, and about 1% by weight Orosol red "B" dye, sold by Ciba Chemical and Dye Company, Fairlawn, New Jersey is prepared by dissolving said materials in methy ethyl ketone (MEK) by stirring at room temperature. This coating formulation is then coated on Ottawa sand of about 650 microns median particle size in the amount of about 40 milliliters of solution per pound of sand. The coating is carried out in a conically shaped coating chamber which has means for mechanical agitation to provide tumbling and which has air entry ports to provide air to assist solvent evaporation. The coating solution is added stepwise to minimize agglomeration and assure good coating integrity. After 40 mls. of solution per pound has been added, the material is removed and placed in an oven where it is cured for about 18 hours at about 190° F. After curing, the material is cooled and screened through a U.S. Standard 18 mesh screen to remove agglomerates. A developer mix is then prepared from 7 pounds of this carrier by physically mixing it with about 1.7% by weight IBM Part No. 1162013 toner. This toner is comprised of styrene/n-butyl methacrylate copolymer, modified maleic rosin, polyvinyl stearate, and carbon black. This developer mix is then installed in an IBM Copier, which has a conventional cascade type developer. The developer mix is used to make 750,000 copies. The copies are of good quality throughout the test. After 750,000 copies, the carrier is microscopically examined. There is very little missing coating and filmed on or impacted toner is discernable but very minimal.

EXAMPLE 2

A coating formulation prepared as in Example 1 is sprayed onto steel beads having an average diameter of about 300 microns and a surface suitably clean for adhesion. This material is sprayed onto the beads in a fluidized bed coating apparatus at a temperature of about 80° F. and about 50 milliliters per pound is applied at a rate of about 30 milliliters per minute. The coated beads are then dried for about 5 minutes in the fluidized bed coating tower at a temperature of about 70° F.

The coated beads are then placed in an oven, and the temperature of the beads is brought to about 190° F. for about 6 hours. The temperature is then raised to about 210° F. for about one hour; then the beads are removed from the oven and cooled to room temperature via ambient air cooling. The material is next screened through a U.S. Standard 30 mesh screen to remove agglomerates.

A 14 pound developer mixture, comprising the above coated beads and a conventional styrene/methacrylate/carbon black toner is prepared at a toner concentration of about one percent by weight. The developer mixture is then placed in a bucket brigade magnetic brush developer unit and placed in an electrophotographic robot employing the normal electrophotographic process steps of charging, imaging, developing, transferring, and cleaning.

At a process speed of about 5 inches per second, approximately 27,000 copies were produced. After approximately 15,000 copies, the copy showed significant degradation through loss of resolution and increasing background due to filmed on toner, but had not as yet reached unacceptable levels. At 27,000 copies the copy was totally unacceptable and the copy run was terminated.

At 27,000 copies, microscopic examination of the carrier revealed significant filmed on toner. Curve 1 of the drawing displays the approximate rate of filmed on toner accumulation.

EXAMPLE 3

A coating formulation containing essentially polytetrafluoroethylene and water, which is sold by E. I. Dupont de Nemours and Company as 852-201 Clear Teflon Enamel, is diluted about one volume to one volume with distilled water by stirring at room temperature and sprayed onto steel beads having an average diameter of about 300 microns and a surface suitably clean for adhesion. About 30 milliliters of the diluted material is applied per pound of steel beads at a temperature of about 120°-130° F. in a fluidized bed coating apparatus. The composite material so prepared is now cured in an oven at about 700° F. for about 15-20 minutes to sinter and coalesce the deposited resin particles. The material is then cooled to room temperature and screened through a U.S. Standard 35 mesh screen to remove agglomerates. A developer mix is then prepared from about 14 pounds of this carrier by physically mixing it with about 1% by weight of a conventional styrene-methacrylate-carbon black toner.

This developer mix is then installed in the same electrophotographic copy robot as discussed in Example 2 and 100,000 copies are made. After about 35,000 copies are made, it was noted that some specks are present on the background areas of the copy which did not resemble toner background. Upon microscopic examination, it was found that the specks are flecks (or pieces) of Teflon from the carrier coating. Upon examining the carrier, it is found that substantially no toner had filmed to the carrier coating, however, considerable spalling of the coating had occurred. Other than the occasional specks, the copy is good at 35,000 copies, therefore, the test is resumed and run to 100,000 copies. At 100,000 copies, the copy is still good except for the background specks which have increased slightly in number. The carrier at 100,000 copies is badly spalled, that is substantial amounts of the coating are missing leaving much exposed steel. There is substantially no filmed on toner on the remaining coating, however, there is toner filmed to the exposed steel. The approximate rate of filmed on toner accumulation on the core is illustrated by curve II in the drawing.

EXAMPLE 4

A coating formulation consisting of 850-201 Teflon Primer for steel, which is sold by Dupont, is diluted about two volumes to one volume with distilled water by stirring at room temperature and sprayed onto steel beads having an average diameter of about 300 microns and a surface suitably clean for adhesion. The coating formulation of 850-201 Teflon Primer for steel is a solution comprising, by weight, approximately 35% polytetrafluoroethylene, approximately 12% chromic and phosphoric acids, and about 53% water. The material is applied to the beads in a fluidized bed coating apparatus at a temperature of about 170° F. About 35 milliliters of the diluted material is applied per pound of beads. The acids react with the core material in such a manner as to promote adhesion. The primed beads are now removed from the apparatus, placed in an oven, and the temperature of the beads is brought to about 530° F. and left there for about 11 minutes. The beads are now removed from the oven, cooled to room temperature via ambient air cooling, and then placed back into the fluidized bed apparatus.

A coating formulation of Dupont 852-201 Clear Teflon Enamel diluted about two volumes to one volume with water by stirring at room tempeature is now sprayed onto the beads in the fluidized bed apparatus at a coating temperature of about 170° F. The coating formulation of 852-201 Clear Teflon Enamel contains, by weight, approximately 48% polytetrafluoroethylene, approximately 3% of a surface active agent (blend of alkyl aryl polyether alcohol with organic sulfonate), and approximately 49% water and toluene in the ratio of 95 to 5. About 45 milliliters of the diluted material are applied per pound of beads.

The beads are then removed from the tower, placed in an oven, and the temperture of the beads is brought to about 780° F. and left there for about 11 minutes, to sinter and coalesce the deposited fluorocarbon particles. The material is then cooled to room temperature via ambient air cooling and screened through a U.S. Standard 35 mesh screen to remove agglomerates.

A developer mix is now prepared from about 14 pounds of this carrier by physically mixing it with about 1% by weight of the same conventional styrene/methacrylate toner used in Example 3. This developer mix is then installed in the same developer and robot as was used in Examples 2 and 3 and 100,000 copies are made. The copy is very good throughout the 100,000 copies. The carrier has essentially no filmed on toner as is seen from the data points designated by squares of FIG. 1. There are no discernable Teflon specks on the copy. Microscopic examination of the carrier reveals a finite amount of spalling but far less than in Example 3. The carrier life in this test was something considerably in excess of 100,000 copies.

EXAMPLE 5

Approximately 22 pounds of carrier essentially the same as that described in Example 4 above and prepared in an essentially same manner is installed in a later level modification of the magnetic brush developer described in Examples 2, 3, and 4 above—the carrier being included as a developer mixture including a commercial toner designated as IBM Part No. 1162051, described in U.S. application Ser. No. 110,756, referenced above. The magnetic brush developer containing the developer mixture is placed in a copier apparatus.

At a process speed of approximately 9 inches per second, 250,000 copies are made with good resolution, and low background, good half-tones and extended area coverage. Microscopic examination at 250,000 copies reveals relatively little spalling, chipping, or flaking; essentially no filmed on toner; and only about 10 percent coating loss. Thus, the carrier is quite functional after 250,000 copies and has an as yet undetermined actual life that far exceeds 250,000 copies.

From the foregoing examples it is clearly evident that polytetrafluoroethylene is a highly preferred carrier coating.

It additionally has been experimentally found that carriers prepared substantially as in Examples 3 and 4 show particularly beneficial effects when used in other hostile developer environments such as with a development electrode, where the core need not be magnetic but must be electrically conductive.

Further, preliminary tests indicate that fluorinated ethylene propylene, being fully saturated with fluorine atoms on the ethylene and propylene chains, provides the necessary and desirable low surface energy characteristics of polytetrafluoroethylene and is a highly desirable electro negative carrier coating for use in electrostatic developers and particularly in hostile environment elecrostatic or electrophotographic developer apparatuses.

The preferred thicknesses of the coating of the fluorocarbons as described in the above examples range from about 1 micron to 3 microns in thickness for the primer layer and from about 2 microns to 5 microns in thickness for the exterior polytetrafluoroethylene outer layer. The primer layer may be as thin as about 0.1 microns and still have sufficient priming effect to promote good adhesion and may be as thick as about 5 microns.

The thickness of the exterior coating layer whether coated over the primed or unprimed carrier particulate material, may be as thin as about 0.1 micron and still have a sufficient thickness to adequately impart the desired triboelectric charge and magnitude and polarity to the toner, and have a significant life, while the layer may be as thick as up to about 10 microns, and still maintain physical integrity and withstand physical degradation in the hostile environment.

While the invention has been particularly shown and described with reference to preferred embodiments thereof it will be understood by those skilled in the art that the foregoing and other changes in form and details may be made therein without departing from the spirit and scope of the invention.

We claim:

1. A long lasting triboelectrically negative carrier for use in a developer mixture of an electrophotographic process using electroscopic fusible toner particles smaller than said carrier having electrode or magnetic brush development consisting essentialy of:

a ferromagnetic, electrically conductive core having a size of from 50 to 600 microns;

a continuous thin coating of fully fluorine saturated hydrocarbon solid polymer in uniform thickness up to 10 microns on said core, said coating providing triboelectric charge for the toner particles and which coating is strongly resistant to fused on toner filming, whereby the toner particles will adhere to the carrier by virtue of said negative triboelectric charge.

2. A method of manufacturing a triboelectrically negative carrier for use in a developer mixture in an electrophotographic process having electrode or magnetic brush development consisting essentially of:

spraying ferromagnetic, electrically conductive cores of a size from 50 to 600 microns with a dispersion of a fully fluorine saturated hydrocarbon solid polymer at a temperature of about 120 degrees to 180 degrees F. in a fluidized bed to uniformly apply said solid polymer in a thickness up to 10 microns;

sintering the coated cores at an elevated temperature to sinter and coalesce particles of said solid polymer in said coating to render uniform and set said continuous coating; and cooling said cores and screening said cores to remove agglomerates.

3. A long lasting triboelectrically negative carrier for use in a developer mixture with electroscopic fusible toner particles smaller than said carrier for an electrophotographic process having electrode or magnetic brush development, consisting essentially of:

a ferromagnetic, electrically conductive core having a size of from about 50 to 600 microns;

a first coating of primer material in a uniform thickness of up to 5 microns, said first coating comprising a fully fluorine saturated hydrocarbon solid polymer and a mixture of chromic and phosphoric acids for reacting with said core to improve adhesion;

a second coating in a uniform thickness of up to about 10 microns of a substantially continuous phase of fully fluorine saturated hydrocarbon solid polymer;

the combined thickness of both said first and second coatings being up to about 10 microns; and said outer coating providing the triboelectric charge for the toner particles and being strongly resistant to fused on toner filming, whereby toner particles will adhere to the carrier by virtue of said negative triboelectric charge.

* * * * *

UNITED STATES PATENT AND TRADEMARK OFFICE

CERTIFICATE OF CORRECTION

PATENT NO. :4,147,834

DATED :April 3, 1979

INVENTOR(S) :Howard E. Munzel; Carl A. Queener

It is certified that error appears in the above-identified patent and that said Letters Patent are hereby corrected as shown below:

Column 6, line 10, "of process" should read --to possess--.

Column 9, line 61, "rosin" should read --resin--.

Signed and Sealed this

*Ninth* Day of *October 1979*

[SEAL]

*Attest:*

RUTH C. MASON
*Attesting Officer*

LUTRELLE F. PARKER
*Acting Commissioner of Patents and Trademarks*